US005407490A

United States Patent [19]

Zofchak

[11] Patent Number: 5,407,490

[45] Date of Patent: Apr. 18, 1995

[54] METHOD FOR RELEASING BLACK TOP OR OTHER STICKY MATERIALS FROM A TRUCK BED

[76] Inventor: Albert Zofchak, 6 Gulfstream Blvd., Matawan, N.J. 07747

[21] Appl. No.: 971,197

[22] Filed: Nov. 4, 1992

Related U.S. Application Data

[63] Continuation-in-part of Ser. No. 538,787, Jun. 15, 1990, abandoned.

[51] Int. Cl.[6] ..... B08B 3/00; B08B 7/00

[52] U.S. Cl. ..... 134/34; 134/4; 134/40; 252/170; 252/DIG. 1

[58] Field of Search ..... 134/40, 39, 34, 4; 106/2; 252/170, DIG. 1; 208/45; 428/543

[56] References Cited

U.S. PATENT DOCUMENTS

| | | | |
|---|---|---|---|
| 2,715,594 | 8/1955 | Garrison | 134/40 |
| 4,108,681 | 8/1978 | Lawson et al. | 134/40 |
| 4,279,660 | 7/1981 | Kamo et al. | 208/45 |
| 4,324,651 | 4/1982 | Rollman et al. | 208/45 |
| 4,619,779 | 10/1986 | Handy | 252/91 |
| 4,804,495 | 2/1989 | Bouchez et al. | 252/312 |

*Primary Examiner*—Richard D. Lovering
*Assistant Examiner*—Joseph D. Anthony
*Attorney, Agent, or Firm*—Anthony D. Cipollone

[57] ABSTRACT

This invention presents a new method of using a composition of monomethyl coconate esters with emulsifiers as a release compound causing black top, asphalt or other sticky materials that stick to a truck bed to slide and release from the surface of the truck. The composition is sprayed as a mixture on the truck bed with water in ratio of 1 part composition to 20–30 parts water with a hose of form a thin layer on a truck bed. The black top, asphalt or other sticky material is loaded and discharged and the mixture is washed away from a truck bed by hosing down the truck bed with water.

1 Claim, No Drawings

METHOD FOR RELEASING BLACK TOP OR OTHER STICKY MATERIALS FROM A TRUCK BED

This application is a continuation-in-part of U.S. patent application Ser. No. 07/538,787 filed Jun. 15, 1990, now abandoned.

BACKGROUND OF THE INVENTION

1. Field of the Invention

This invention relates to the use of a release composition on the truck bed that cause black top and other sticky materials to slide and release from the surface of the truck.

The instant invention provides a method for releasing black top or other sticky materials from the truck bed which comprises either applying the composition to the truck bed before the black top or other material is loaded and/or applying the composition to the sticking black top or other material after the truck has been unloaded as a detergent composition.

The preferred embodiment of the instant invention is indicated in the following formulations:

| Materials: | % |
|---|---|
| Methyl Coconate | 94.0 |
| Tween 80 (20 mole ethoxylate sorbitan monooleate) | 4.0 |
| Tween 20 (20 mole ethoxylate sorbitan monolaurate) | 2.0 |

Coconut Acid is a mixture of fatty acids varying in length from 6 to 18 carbon atoms. It reacts with methyl alcohol to produce methyl coconate as follows:

$$R_1COOH + HOR_2 \longrightarrow R_1-\overset{\overset{\displaystyle O}{\|}}{C}-OR_2$$

where $R_1$ varies from $C_5H_9CH_2$ to $C_{17}C_{35}CH_2$—; and $R_2=CH_3$—.

2. Description of Prior Art

U.S. Pat. No. 4,238,373, issued Dec. 9, 1980, describes a process for making detergent compositions containing nitrogenous cationic surfactants.

U.S. Pat. No. 4,619,779 issued Oct. 28, 1986, describes a detergent additive product comprising a C5–C18 aliphatic carboxylic acid bleach precursor in water releasable combinations.

OBJECTS AND SUMMARY OF THE INVENTION

It is the object of the instant invention to introduce a method of releasing black top and other sticky materials that stick to the truck bed by using a release composition which is applied to the truck bed before the black top or other sticky material is loaded and/or applying the composition to the sticking black top or other material after the truck has been unloaded as a detergent.

The prepared embodiment of the composition is as follows:

| | |
|---|---|
| Methyl Coconate | 94.0% |
| Tween 80 | 4.0% |
| Tween 20 | 2.0% |

The truck beds on which said composition is used are steel or stainless steel. Said composition is sprayed on the truck bed before loading the truck from a drum containing the composition with a proportionation hose that combines water with the composition in a ratio of 1 part composition/20–30 parts water depending on user preference. This mixture of water and composition forms a layer to cover truck bed similar to a "teflon" type layer on truck bed before loading. The most prevalent sticky materials for which this process is used are asphalt and "black top".

After the sticky material is unloaded the truck bed is washed and sprayed with plain water which washes away the said composition residue. No scrubbing is necessary. The truck bed steel or stainless steel surface is clean and shiny ready for the next application.

The composition is biodegradable and far superior in use and safer for the environment as opposed to previously used diesel fuel and kerosene which are non-biodegradable and banned from use.

The truck bed is made of steel or stainless steel. The said composition remains effective as long as the sticky materials remain on the truck bed and the said composition acts much like a thin "teflon" layer until the truck is unloaded. Finally the truck bed is sprayed with water to wash the residue of composition layer and the truck bed is ready for next application.

The composition is applied as described using a water hose to combine the composition from a drum with water using a proportionation hose to give a ratio of 1 part composition/20–30 parts water depending on user preference.

What is claimed is:

1. A method for releasing black top, asphalt and other sticky materials from a steel or stainless steel truck bed, which comprises using a composition comprising 94.0% mono-methyl coconate, 4.0% 20 mole ethoxylate sorbitan monooleate and 2.0% 20 mole ethoxylate sorbitan monolaurate, said composition sprayed on said truck bed with water in a ratio of one part said composition to 20–30 parts water to form a mixture, spraying said mixture through a hose to the said truck bed to form a thin layer on said truck bed before the black top, asphalt or other sticky material is loaded onto said truck bed, with said mixture washed away from said truck bed by water after unloading the said black top, asphalt or other sticky material.

* * * * *